US010937266B2

(12) United States Patent
Jain

(10) Patent No.: US 10,937,266 B2
(45) Date of Patent: Mar. 2, 2021

(54) BANKNOTE PROCESSING MACHINE HAVING POWER CONTROL ELECTRONICS

(71) Applicant: GIESECKE & DEVRIENT GMBH, Munich (DE)

(72) Inventor: Amit Kumar Jain, Delhi (IN)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 304 days.

(21) Appl. No.: 15/532,955

(22) PCT Filed: Dec. 2, 2015

(86) PCT No.: PCT/EP2015/002416
§ 371 (c)(1),
(2) Date: Jun. 2, 2017

(87) PCT Pub. No.: WO2016/087040
PCT Pub. Date: Jun. 9, 2016

(65) Prior Publication Data

US 2017/0330403 A1 Nov. 16, 2017

(30) Foreign Application Priority Data

Dec. 3, 2014 (IN) ..... 3527/DEL/2014

(51) Int. Cl.

| | |
|---|---|
| ***G07D 11/40*** | (2019.01) |
| ***G07D 11/26*** | (2019.01) |
| ***G07D 11/32*** | (2019.01) |
| ***G07D 11/235*** | (2019.01) |

(52) U.S. Cl.
CPC ..... *G07D 11/26* (2019.01); *G07D 11/235* (2019.01); *G07D 11/32* (2019.01); *G07D 11/40* (2019.01); *G07D 2211/00* (2013.01)

(58) Field of Classification Search
CPC ..... G07D 11/26; G07D 11/40; G07D 11/235; G07D 11/32; G07D 2211/00; G07G 1/0009; G07G 1/12
USPC ..... 700/297
See application file for complete search history.

(56) References Cited

U.S. PATENT DOCUMENTS 4,711,441 A 12/1987 Taylor
4,819,237 A * 4/1989 Hamilton ..... G06F 11/0763 714/22
5,237,494 A * 8/1993 Baader ..... H02P 5/74 361/709

(Continued)

OTHER PUBLICATIONS

International Search Report for corresponding International PCT Application No. PCT/EP2015/002416, dated Feb. 25, 2016.

*Primary Examiner* — Kenneth M Lo
*Assistant Examiner* — Michael W Choi
(74) *Attorney, Agent, or Firm* — Workman Nydegger

(57) ABSTRACT

The invention provides a banknote processing machine having a power control electronics that comprises: —a low voltage monitor constructed to detect a lowering of a voltage of the power delivered by the power source below a minimum voltage; and —a power failure control circuit constructed to, in the case that a lowering of said voltage below said minimum voltage occurs, discontinue supply of power to a first group of said elements and to continue supply of power to a second group of said elements.

12 Claims, 3 Drawing Sheets

(56) References Cited

U.S. PATENT DOCUMENTS

| | | | | |
|---|---|---|---|---|
| 5,734,230 | A * | 3/1998 | Edwards | H02J 3/14 307/66 |
| 6,201,371 | B1 | 3/2001 | Kawabe et al. | |
| 8,025,214 | B1 | 9/2011 | Folk et al. | |
| 8,227,936 | B1 * | 7/2012 | Folk | G07F 19/202 307/64 |
| 2001/0022472 | A1 * | 9/2001 | Codina | H02J 9/061 307/66 |
| 2002/0000913 | A1 | 1/2002 | Hamamoto et al. | |
| 2004/0252613 | A1 * | 12/2004 | Iwakiri | G03B 42/02 369/53.12 |
| 2005/0207634 | A1 * | 9/2005 | Jones | G06Q 20/18 382/135 |
| 2008/0291607 | A1 * | 11/2008 | Braunstein | H01R 25/006 361/601 |
| 2012/0212051 | A1 * | 8/2012 | Heidenreich | H02J 9/062 307/23 |
| 2012/0312870 | A1 * | 12/2012 | Ma | G07F 19/207 235/379 |
| 2017/0277603 | A1 * | 9/2017 | Zhu | G06F 1/30 |

* cited by examiner

BANKNOTE PROCESSING MACHINE HAVING POWER CONTROL ELECTRONICS

TECHNICAL FIELD

The invention relates to a banknote processing machine having power control electronics constructed to supply power delivered by a power source to the parts of the machine.

BACKGROUND OF THE INVENTION

A banknote processing machine processes banknotes while they are transported through the machine along a transport path of the machine. Basically, the elements of a banknote processing machine can be grouped into mechanical parts, electromechanical parts, sensors, control electronics, software and interface means to an operator.

The transporting of the banknotes is achieved by the electromechanical transport parts, e.g. motors, and mechanical transport parts, e.g. wheels, transport belts and mechanical gates. The mechanical parts are driven by the electromechanical parts, e.g. motors and solenoids. Wheels and belts are used to transport the banknotes. Solenoid driven mechanical gates at branchings of the transport path are used to channel banknotes to one of several possible branches. The processing of a banknote implies, for example, capturing of features of the banknote by different sensors and channeling of banknotes at branchings in the transport path according to captured sensor measurements. Sensors are provided for capturing the number of transported banknotes, serial numbers and quality features of the transported banknotes. The sensors are placed along the transport path, so that the banknotes are transported to pass by the sensors when they are transported along the transport path via the mechanical transport parts.

To process a batch of banknotes, the batch is fed into the banknote processing machine, transported through the machine and processed thereby, and finally all banknotes of the batch are output out of the machine. For the feeding in of banknotes, the machine usually has a singler so as to single out banknotes. For the output of the banknotes, the machine has one or several stackers. The entire process starting at feeding in a batch of banknotes into a banknote processing machine and ending at a regular output of all banknotes out of the banknote processing machine is generally called a deposit cycle.

The software of a banknote processing machine comprises an operating system on which application software runs, so as to control the transport of banknotes along the transport path. The application software further saves deposit data captured during a deposit cycle to a persistent deposit data memory. The deposit data comprise for example the number of deposited banknotes, serial numbers of deposited banknotes and/or quality features of the deposited banknotes.

Generally, operating systems and/or applications running under the operating system generate log files containing the data related to the deposit cycle which are then written in volatile working memory. In case of a power failure, such log files are transferred to a persistent memory if there is enough time to write these log files into this memory. If the power supply is interrupted before the log files are saved to the persistent memory, the data is lost. Log files are also used for application software of banknote processing machines.

As an interface means, a banknote processing machines comprises, for example, a touch sensitive display for output of information to an operator and input of control information by an operator.

The power control electronics of a banknote processing machines is designed to control the powering of the electromechanical parts, sensors, software parts and interface means.

When a power failure occurs at the banknote processing machine during a running deposit cycle, the banknote deposit cycle is interrupted. In particular, it can happen that banknotes are transported along sensors which are already powered off. Thus, the application software can miss number counts and/or quality features of banknotes resulting in generation of inconsistent deposit data (e.g. different number of banknotes for fed-in, counted and output banknotes).

In known banknote processing machines, usually the entire deposit cycle has to be restarted when a power failure occurs during the deposit cycle, either due to a loss of log files containing deposit data, or due to inconsistent deposit data.

Generally, there are known power backup systems for backing up power failures, wherein, in the case of a power failure, backup power is provided through an external so-called uninterruptible power-supply UPS or through a battery.

SUMMARY OF THE INVENTION

It is an object of the present invention to provide a banknote processing machine which can get through a power failure occurring during a deposit cycle with reduced disturbing impact of the power failure on the deposit cycle. Preferably, it should be possible to continue a deposit cycle interrupted by the power failure as soon as the power is back.

The object is achieved by a banknote processing machine according to claim 1. Possible and favorable embodiments of the invention are given in dependent claims.

The banknote processing machine according to claim 1 comprises the following elements:

a plurality of electromechanical parts to control a transport of banknotes along a transport path through the banknote processing machine;

a plurality of sensors located along the transport path to capture features of banknotes transported along the transport path while passing by the sensors;

software parts, including application software and a deposit data memory, and configured to transport the banknotes along the transport path, by the electromechanical parts and to generate deposit data according to banknotes having been transported along the transport path, and to store generated deposit data to the deposit data memory;

an interface means to provide an interface between the banknote processing machine and an operator thereof or a network;

power control electronics to supply power delivered by a power source to the electromechanical parts, sensors, software parts and interface means.

The banknote processing machine is characterized in that the power control electronics comprises:

a low voltage monitor to detect a lowering of a voltage of the power delivered by the power source below a minimum voltage; and a power failure control circuit configured to discontinue supply of power to a first group of said elements and to continue supply of power to a second group of said elements in case of lowering of said voltage below said minimum voltage.

The continued supply of power to the second group of said elements is intended to prevent a loss of data emanating from said elements and save a state of system before power failure. Therefore, preferably those elements are continued to be powered from which valuable data such as deposit data is generated. On the other hand, power is scarce in case of a power failure. To make sure that the elements of the second group get enough power during power failure, supply of power is discontinued to a first group of said elements. Preferably, power is discontinued to those elements that consume much power and/or from which no valuable data such as deposit data is generated. Thus, the scarce remaining power during power failure is saved for elements from which valuable data such as deposit data is generated.

With valuable data such as deposit data being saved throughout the power failure and until power is back, a deposit cycle which is just running at the time when the power failure occurs can be continued as soon as the power is back.

According to a preferred embodiment, the power control electronics comprises a super capacitor, which is assembled in the power control electronics such that, as long as the voltage delivered by the power source is above or not below the minimum voltage, the super capacitor is charged In case the voltage delivered by the power source is lowered below said minimum voltage, the super capacitor is isolated from the power source and therefore super capacitor starts discharging to ensure continuous power supply to the second group of elements during power failure. Super capacitors are known to have a very large capacity. Thus, a long-lasting bypassing or bridging of a power failure can be achieved by means of a super capacitor as a backup power source.

According to another preferred embodiment, the power failure control circuit is configured to continue to supply power to at least some elements from the second group of elements, from the time of receiving the low power signal on, for a duration of a power failure period, which is sufficiently long for the respective element to complete a process running at the time of receiving the low power signal. Thus, indefinite states of elements due to incomplete execution of processing steps at said elements are avoided.

According to another preferred embodiment, the first group of elements comprises one or several of the following: at least some or all of the electromechanical parts; at least some or all of the interface means; at least some of the sensors. These elements have in common that they have high power consumption. Thus, disconnecting these elements saves a high amount of power. On the other hand, mechanical parts and interface means and some sensors are not required in handling valuable data such as deposit data. Therefore switching these elements off is not too critical.

According to another preferred embodiment, the second group of elements comprises software parts having the application software and the deposit data memory. Software parts may further refer to a processing means for executing the application software and storing the log files in the deposit data memory. These elements are particularly critical since they handle valuable data such as deposit data and should therefore preferably be continued to be powered during power failure.

According to another preferred embodiment, the second group of elements comprises at least some or all of the sensors. Also some of the sensors can be implied in handling valuable data such as deposit data and should therefore preferably be continued to be powered during power failure.

According to another preferred embodiment, the power failure control circuit is configured to continue to supply power to the sensors for a first holdup period, in particular from about 300 to about 1000 milliseconds, more particular for about 500 milliseconds, and to the deposit data memory for a second holdup period which is larger than the first holdup period, and which is in particular from about 4 to about 10 seconds, more particular from about 5 to about 6 seconds, from the time of the low power signal on.

Preferably, when one or more super capacitor(s) is/are used as a power backup source, the super capacitor(s) is (are) dimensioned adequately so as to achieve desired first and second holding times.

BRIEF DESCRIPTION OF THE DRAWINGS

In the following, embodiments of the invention will be described with reference to the drawings, wherein.

DETAILED DESCRIPTION OF EMBODIMENTS OF THE INVENTION

Figure 1:
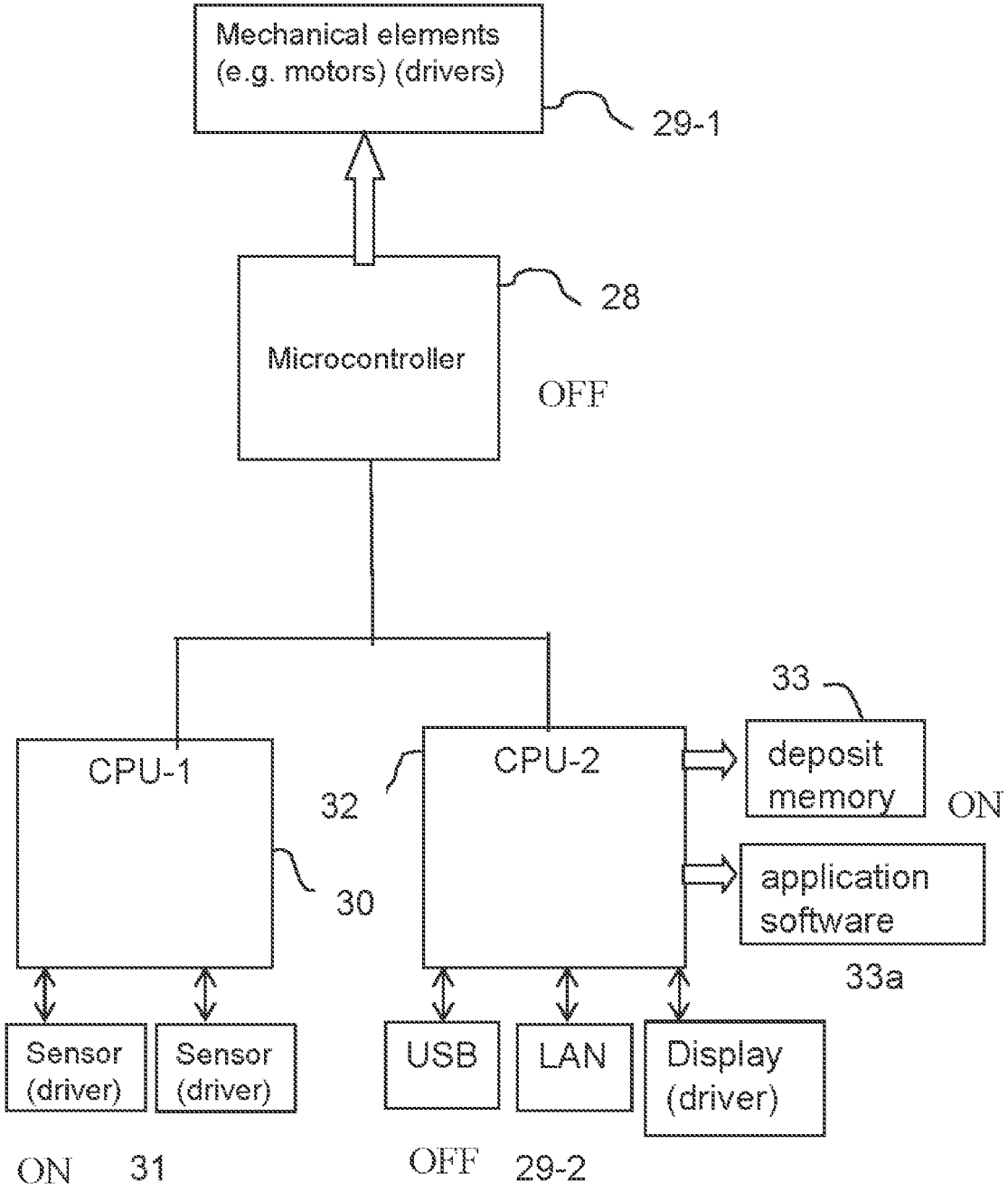
FIG. 1 is a schematic block diagram showing a coarse overview of relevant electronic elements of a banknote processing machine, according to an embodiment of the present invention.

FIG. 1 is a coarse overview showing the crucial electronic elements of the inventive system for power failure handling in a banknote processing machine. The mechanical parts such as stackers, singlers and wheels are not shown. The banknote processing machine comprises a main board having CPUs' and microcontrollers and various other control electronics by which electromechanical parts (electromechanical devices, motors, gates for banknote channeling etc.) and interfaces such as a display and network interfaces (e.g. USB, WLAN) and the like are controlled. In greater detail, a microcontroller 28 is used to control elements which belong to a first group of elements and which are to be switched off more or less immediately on a power failure. The elements of the first group include mechanical elements (drivers) 29-1 such as motors. A first CPU-1 30 is used to control sensors 31 via sensor drivers. A second CPU-2 32 is used to control interface means (drivers) 29-2 including a display and network interfaces USB and WLAN, application software 33*a* and a persistent deposit data memory 33 for storing deposit data. The second CPU-2 32 is used to selectively either power on or off elements, or switch off elements after lapse of a certain time, herein after also called holdup period. The sensors 31 and the application software 33*a* and deposit memory 33 belong to a second group of elements, in that the first and second CPUs 30, 32 are continued to be powered on power failure for a holdup period. The interfaces 29-2 including display and networks interfaces (USB, WLAN) belong to the first group of elements to be selectively switched off by the second CPU 32.

The application software 33*a* runs on operating system of the banknote processing machine, so as to control the transport of banknotes along the transport path. The application software further saves deposit data captured during a deposit cycle to a persistent deposit data memory. The deposit data comprise for example the number of deposited banknotes, serial numbers of deposited banknotes and/or quality features of the deposited banknotes. In an embodiment, the application software 33*a* is stored on local memory of the banknote processing machine and executed by the second CPU 32.

Figure 2:
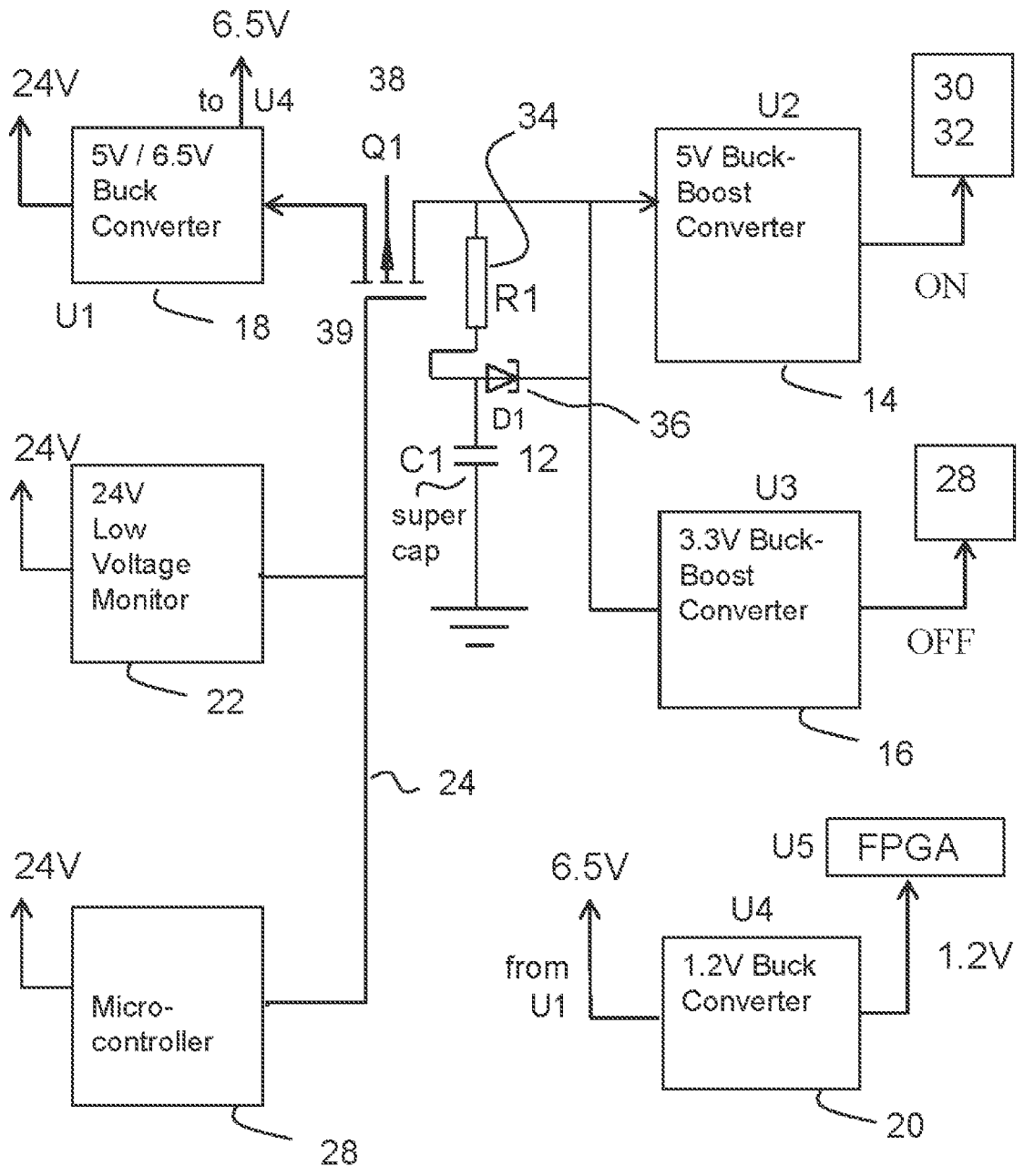
FIG. 2 is a block diagram showing power control electronics using a super capacitor, according to an embodiment of the present invention.

FIG. 2 is a block diagram showing power control electronics using a 24V low voltage monitor 22 and a super capacitor C1 12 as crucial elements, according to an embodiment of the present invention.

The microcontroller 28 and an output 24 of the 24V low voltage monitor 22 are coupled to a gate input 39 of a MOSFET switch Q1 38. The super capacitor C1 12, the CPUs 30, 32 and the microcontroller 28 are connected to a source or drain of said MOSFET switch Q1 38 via converters U2 14, U3 16. A 5V/6.5V buck converter U1 18 is coupled to the other contact (drain or source of the MOSFET Q138, so as to charge the super capacitor C1 12 during normal operation at normal operating voltage (24V). A series resistor R1 34 is connected between the 5V/6.5V buck converterU1 18 so as to limit the charging current. Instead of one super capacitor C1 12 as shown in FIG. 2, two or more super capacitors in series can be provided. The converters U2 and U3 can e.g. be BD8303 from ROHM which are Buck-Boost converters which will generate 5V and 3.3V from an input supply coming from either from the 5V/6.5 V Buck converter U1 18 or from the super capacitor(s) C1.

The normal operating input voltage of the Power supply section supplying power to microcontroller 28 and the CPUs 30, 32 is 24 Volts. The 24V low voltage monitor 22 receives the operating voltage (normally 24 V) at its input. On a power failure, the operating voltage starts falling. As soon as the operation voltage at the input of the 24V low voltage monitor 22 decreases below the specific minimum voltage of 19 Volts (which can have a different value in different embodiments), the output line 24 of the 24V low voltage monitor 22 goes low.

The output 24 of the 24V low voltage monitor 22 is coupled to a gate input 39 of a MOSFET switch Q1 38 which interrupts the microcontroller 28 so as to switch off the mechanical elements 29-1 and interfaces 29-2. This means that all elements directly controlled by the microcontroller 28 are switched off directly. Further, the super capacitor C1 12 is disconnected from the power supply via the MOSFET switch Q1 38.

The CPUs CPU-1 30 and CPU-2 32 are coupled to a drain or source contact of the MOSFET switch Q1 38 via a 5V buck-boost converter U2 14. The microcontroller 28 is coupled to said same drain or source contact of the MOSFET switch Q1 38 via a further converter, assembled to follow the 5V buck-boost converter U2 14, and which is here a 3.3V buck-boost converter U3 16. Thus, when the output 24 of the 24V low voltage monitor 22 goes low on a power failure, the super capacitor, which is now disconnected from the power source, is discharged. Its charge flows to the 5V buck-boost converter U2 14 to generate a 5V voltage output to the first and second CPUs CPU-1 30, CPU2 32. Further, the charge flows to the 3.3V buck-boost converter U3 16 to generate a 3.3V voltage output to the microcontroller 28, as a minimum voltage to keep the microcontroller 28 controllable, even though it has been switched off.

The first CPU CPU-1 30 is provided power at a voltage of 5V along with the sensor driver for a first holding time of about 500 ms (milliseconds) and then switches off the sensors via their sensor drivers 31 as well. By this 500 ms holding time, the sensors can complete capturing processes which are running at the respective sensors at the moment the power failure occurs. Thus, the consistency of deposit date generated from sensor measurements is assured.

The second CPU CPU-2 32 is provided power at a voltage of 5V along with the application software 33*a* and to the deposit data memory 33 for a second holding time of about 5 to 6 seconds and then switches off the application software 33*a* and the deposit data memory 33. The second holding time of 5 to 6 seconds is sufficient for deposit data to be saved to the persistent deposit data memory 33. Optionally, the deposit data are saved by saving log files, which have been generated by the operating system and/or the application software 33*a* during normal operation.

The super capacitor C1 12 output is coupled to both the 5V buck-boost converter U2 14 and the 3.3V buck-boost converter U3 16 through a blocking diode D1 36. The MOSFET switch Q1 38 inserted between the 5V/6.5V buck converter U1 18 (also) effects blocking of a reverse current flow from the super capacitor C1 12 through body diodes present in MOSFETs associated with the 5V/6.V buck converter U1 18.

U4 20 is a 1.2V buck converter whose input is coupled to 6.5V output of 5V/6.5 V buck converter U1 18. U4 20 output (1.2V) is connected to U5 FPGA core supply. When 24V supply fails, FPGA core supply U5 output is turned off and hence 1.2V output of U4 20 is turned off subsequently. This further saves power during power failure.

Figure 3:
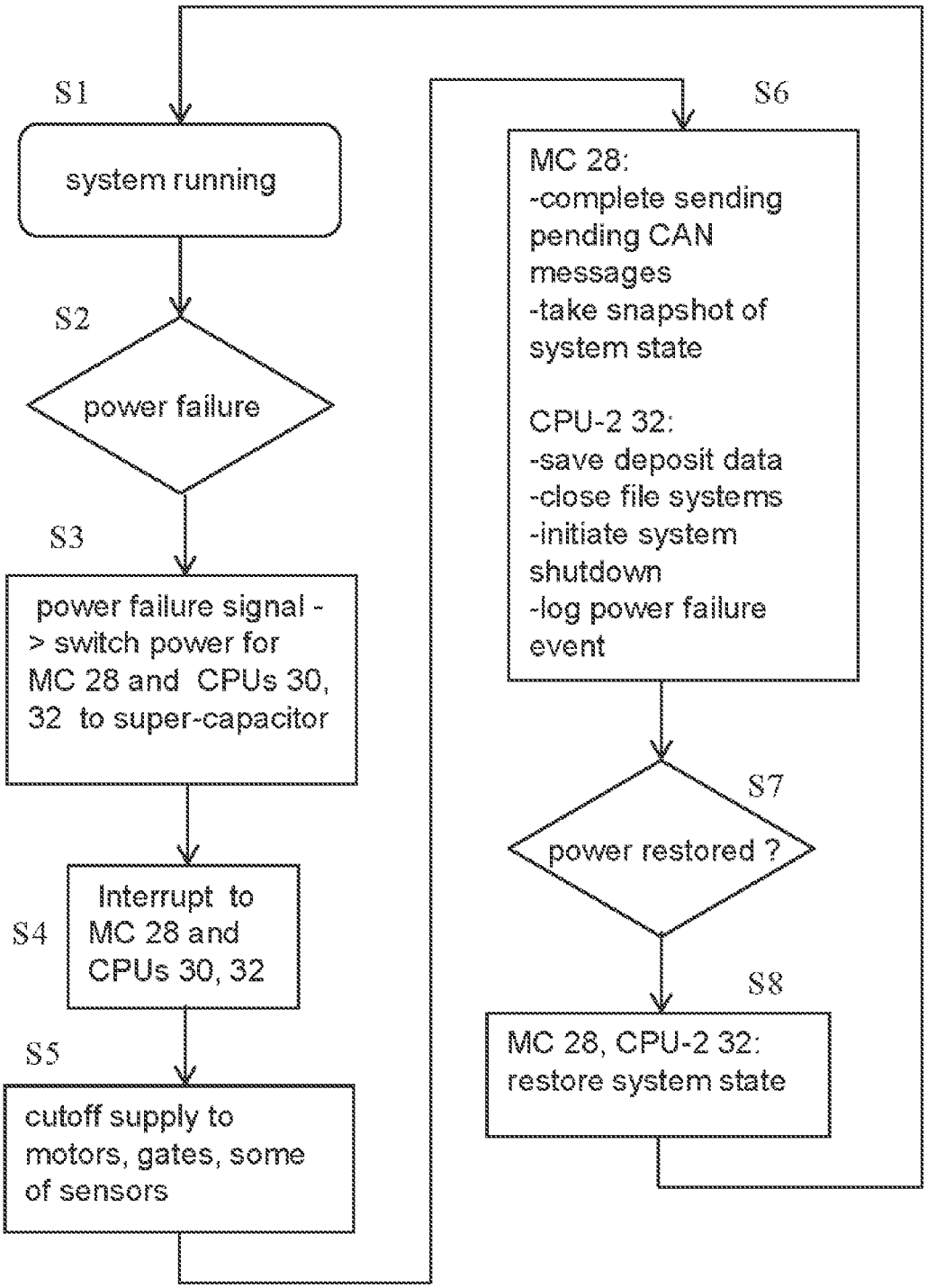
FIG. 3 is a flow chart showing power failure handling process in a banknote processing machine, according to an embodiment of the present invention.

FIG. 3 is a flow chart showing process for power failure handling in a banknote processing machine, as shown in FIG. 1, 2, according to an embodiment of the present invention. At a step marked S1, the entire system of the banknote processing machine is running in a normal mode of operation, performing a deposit cycle. At a step S2 a power failure occurs, resulting in a drop of the 24 V power signal to below 19 V. In reaction, at step S3, a power failure signal occurs at the output 24 of the 24V low voltage monitor 22. Consequently, at step S4, an interrupt signal is sent to the microcontroller MC 28 and to the CPUs CPU-1 30 and CPU-2 32. In a step S5, motors, mechanical gates and some sensors 31 are cutoff from the power supply, wherein the motors and mechanical gates are controlled directly via microcontroller MC 28 and the concerned sensors 31 are controlled via CPU-1 30. In a step S6, the microcontroller MC 28, minimum powered by the 3.3V Buck-Boost Converter U3 16, completes sending pending messages, in particular CAN bus messages if a CAN bus system is used. In addition, microprocessor MC 28 takes snapshots of its own system state. Further, the CPU-2 32 responsible for application software 33*a* and deposit memory 33 saves the deposit data to the deposit memory 33, closes the file system, initiates a system shutdown of the CPU-2 32 and logs the power failure event to a log file. In a step S7, a check is performed, if the supply of power is restored. Step S7 can be done several times, if required. When according to step S7, the supply of power is restored, in a step 8 the microcontroller MC 28 and the CPU-2 32 restore their system state using system state data, log data, deposit data and the like generated or saved in step S6. By step 8, the banknote processing machine is set into a step to restart normal operation according to step 1.

REFERENCE NUMERALS

C=capacitor
D=diode

Q=(MOSFET) switch
R=resistor
U=converter
12=super capacitor
U2/14=5V buck boost converter to power CPU-1 and CPU-2
U3/16=3.35V buck boost converter to power microprocessor 28
U1/18=5V/6.5V buck converter to charge super capacitor during normal operation
U4/20=1.2V buck converter to power FPGA U5
U5=FPGA
22=24 V Low Power/Low Voltage Monitor
24=output of Low Power/Low Voltage Monitor 22
28=microcontroller for electromechanical parts or devices 29-1 and interface means 29-2 (switched off on power failure)
29-1=drivers for electromechanical parts or devices, e.g. motor drivers, electromechanical gate drivers
29-2=interface means in form of operator interface (touch sensitive display) and network interfaces (e.g. USB, WLAN)
30=CPU-1 for controlling sensors drivers 31 ((partly) continued to be powered on power failure)
31=sensor drivers
32=CPU-2 for controlling application software 33-*a* and deposit memory 33 (continued to be powered on power failure)
33=deposit memory
33*a*=application software
R1/34=series resistor between buck converter U1/18 output and super capacitor C1/22 to limit charging current
D1/36=blocking diode to 5V buck-boost converter U2/14 and 3.3V buck-boost converter U3/16
Q1/38=MOSFET switch between 5V/6.5V buck converter U1/18 and rest of circuitry to block reverse current flow from super capacitor through body diodes of MOSFETs associated with 5V/6.5V buck converter U1/18
39=gate input of MO SFET Q1/38 switch

I claim:

1. A banknote processing machine comprising the following elements:

a plurality of electromechanical parts to control a transport of banknotes along a transport path through the banknote processing machine;

a plurality of sensors located along the transport path to capture features of banknotes transported along the transport path while passing by the plurality of sensors;

a computer system including one or more processors and a storage device having executable instructions stored thereon that when executed by the one or more processors configure the computer system to control transport of the banknotes along the transport path by the plurality of electromechanical parts, said computer system being configured to generate deposit data based on banknotes that have been transported along the transport path, said computer system including a deposit data memory and said computer system being configured to store generated deposit data to the deposit data memory, said executable instructions including application software;

an interface between the banknote processing machine and an operator thereof or a network;

a power control configured to supply power delivered by a power source to the plurality of electromechanical parts, the plurality of sensors, the computer system, and the interface;

wherein the power control includes a low voltage monitor that detects a lowering of a voltage of the power delivered by the power source below a minimum voltage and to provide a low power signal; and a power control circuit that receives an output from the low voltage monitor, wherein the power control circuit is configured to continue to supply power to the plurality of sensors for a first holdup period; and to the deposit data memory for at least a second holdup period which is larger than the first holdup period; and wherein, based on said output, the power control circuit discontinues, after the first holdup period, supply of power to a first group of components of said elements of the banknote processing machine and continues supply of power to a second group of components of said elements of the banknote processing machine when said voltage falls below said minimum voltage;

wherein the first group of components of said elements comprises one or several of the following: at least some or all of the plurality of electromechanical parts, at least some or all of the interface, and a first subset of the plurality of sensors;

wherein the second group of components of said elements includes the deposit data memory, at least one of the one or more processors responsible for the application software, and a second subset of the plurality of sensors, the second subset of the plurality of sensors being different than the first subset of the plurality of sensors;

wherein the deposit data generated by the computer system includes log files that contain data related to a deposit cycle of the banknote processing machine;

wherein upon an output of the low power signal from the low voltage monitor the computer system saves the log files of the deposit cycle to the deposit data memory;

wherein the power control comprises a super capacitor, which is assembled in the power control such that, as long as the voltage delivered by the power source is above or not below the minimum voltage, the super capacitor is charged, and in the case that the voltage delivered by the power source is lowered below said minimum voltage, the super capacitor is isolated from the power source and discharged to ensure continuous power supply to the second group of components of said elements.

2. The banknote processing machine of claim 1, wherein the power control circuit is configured to ensure continuous power supply to at least some elements from the second group of components of said elements, from the time of receiving the low power signal, for a duration of a power failure period which is sufficiently long for the respective element to complete a process running at the time of receiving the low power signal.

3. The banknote processing machine of claim 1, wherein the first group of components of said elements comprises the following: at least some or all of the plurality of electromechanical parts; at least some or all of the interface;

and at least some of the plurality of sensors.

4. The banknote processing machine of claim 1, wherein the second group of components of said elements comprises at least one or several of the following:

the application software and the deposit data memory.

5. The banknote processing machine of claim 1, wherein the second group of components of said elements comprises all of the plurality of sensors.

6. The banknote processing machine according to claim 1, wherein the first holdup period is from about 300 to about 1000 milliseconds.

7. The banknote processing machine according to claim 1, wherein the second holdup period is from about 4 to about 10 seconds from the time the low power signal goes on.

8. The banknote processing machine according to claim 1, wherein the power control circuit is configured to continue to supply power to the deposit data memory for the second holdup period which is from about 5 to about 6 seconds from the time the low power signal goes on.

9. The banknote processing machine of claim 1, wherein the first group of components of said elements includes at least some or all of the plurality of electromechanical parts.

10. The banknote processing machine of claim 1, wherein the first group of components of said elements includes at least some or all of the interface.

11. The banknote processing machine of claim 1, wherein the first group of components of said elements includes at least some of the plurality of sensors.

12. The banknote processing machine according to claim 1, wherein the power control circuit is configured to continue to supply power to the plurality of sensors for the first holdup period of about 500 milliseconds.

* * * * *